US008234819B2

(12) United States Patent
Petrov

(10) Patent No.: US 8,234,819 B2
(45) Date of Patent: Aug. 7, 2012

(54) PIVOTING GUTTER ASSEMBLY SUPPORTED BY MAGNETIC LATCHES

(75) Inventor: Dimitri Petrov, Montreal (CA)

(73) Assignee: Dimitri Petrov Consultants Inc., Montreal, Quebec (CA)

( * ) Notice: Subject to any disclaimer, the term of this patent is extended or adjusted under 35 U.S.C. 154(b) by 133 days.

(21) Appl. No.: 12/381,141

(22) Filed: Mar. 9, 2009

(65) Prior Publication Data

US 2009/0229191 A1 Sep. 17, 2009

(51) Int. Cl.
*E04D 13/072* (2006.01)

(52) U.S. Cl. ..... 52/16; 52/11; 52/DIG. 4; 248/48.2

(58) Field of Classification Search ..... 52/11, 16, 52/DIG. 4, 12, 15; 248/48.1, 48.2; 292/251.5
See application file for complete search history.

(56) References Cited

U.S. PATENT DOCUMENTS

| | | | | | |
|---|---|---|---|---|---|
| 2,631,801 | A | * | 3/1953 | Toal | 248/48.1 |
| 4,019,290 | A | * | 4/1977 | Manty | 52/11 |
| 4,446,658 | A | | 5/1984 | Gouin | |
| 4,561,616 | A | * | 12/1985 | Robinson | 248/48.2 |
| 4,745,657 | A | * | 5/1988 | Faye | 16/226 |
| 4,813,190 | A | * | 3/1989 | Wittig | 52/11 |
| 4,837,987 | A | * | 6/1989 | Fender | 52/11 |
| 5,063,638 | A | * | 11/1991 | Howard et al. | 16/238 |
| 5,127,133 | A | * | 7/1992 | Brucker | 16/373 |
| 5,146,718 | A | | 9/1992 | Baskett | |
| 5,184,435 | A | * | 2/1993 | Sherman | 52/12 |
| 5,274,965 | A | | 1/1994 | Jackson | |
| 5,317,843 | A | * | 6/1994 | Sheehan | 52/11 |
| 5,335,460 | A | * | 8/1994 | Smith, Jr. | 52/11 |
| 5,417,015 | A | * | 5/1995 | Coyne | 52/11 |
| 5,649,681 | A | * | 7/1997 | Faye | 248/48.1 |
| 5,752,347 | A | | 5/1998 | Osborn | |
| 5,893,239 | A | * | 4/1999 | Leahy | 52/11 |
| 5,896,706 | A | | 4/1999 | Pike | |
| 5,915,805 | A | * | 6/1999 | Lee | 312/405 |
| 6,233,876 | B1 | | 5/2001 | Obidniak | |
| 6,240,679 | B1 | * | 6/2001 | Smalara | 52/16 |
| 6,389,755 | B1 | * | 5/2002 | Wenner | 52/16 |
| 6,681,527 | B2 | * | 1/2004 | Baker | 52/12 |
| 6,735,907 | B2 | * | 5/2004 | Stevens | 52/12 |
| 6,981,540 | B2 | * | 1/2006 | Deblois | 160/371 |
| 7,152,376 | B2 | * | 12/2006 | Wyatt | 52/11 |
| 7,334,369 | B2 | * | 2/2008 | Carson | 52/11 |
| 7,357,360 | B2 | * | 4/2008 | Staggs | 248/48.1 |
| 7,891,141 | B2 | * | 2/2011 | Kennedy | 52/11 |
| 2002/0073631 | A1 | * | 6/2002 | Baker | 52/12 |
| 2003/0089046 | A1 | * | 5/2003 | Stevens | 52/11 |
| 2006/0145485 | A1 | * | 7/2006 | Hapke | 292/251.5 |
| 2007/0138806 | A1 | * | 6/2007 | Ligtenberg et al. | 292/251.5 |

* cited by examiner

*Primary Examiner* — William Gilbert
*Assistant Examiner* — Alp Akbasli

(57) ABSTRACT

The invention relates to means and methods for maintaining a gutter assembly either in the upward, rain-gathering position or in the downward position under the eaves, where it can be cleaned with a water jet. In the downward position, the gutter assembly remains protected from snow and ice sliding from the roof. Brackets fixated to magnetic latches attached to the fascia support the gutter. Closed magnetic latches maintain the gutter assembly in the upward position. Open magnetic latches maintain the gutter assembly in the downward position. Transition from the upward to the downward position, or vice versa, is achieved from the ground by means of a hook and a U-shaped fork attached to a pole. If the gutter is left in the upward position in winter, snow and ice sliding from the roof will push it to the downward position without damaging it.

9 Claims, 11 Drawing Sheets

PIVOTING GUTTER ASSEMBLY SUPPORTED BY MAGNETIC LATCHES

BACKGROUND

1. Field

The present invention relates to a pivoting gutter assembly which in the upward position gathers rain water. In the downward position it can be easily cleaned and remains protected under the eaves from snow and ice sliding from the roof.

2. Prior Art

Several patents address the requirement for pivoting gutters that collect rain water in the upward position and are accessible for cleaning in the downward position. In a few cases the gutter in the downward position is also protected from snow and ice sliding from the roof.

U.S. Pat. No. 4,446,658 discloses a rain gutter made of flexible material. A mechanism is required to open the flexible gutter so that it can collect rain water, and fold it in winter to prevent it from accumulating snow and ice.

U.S. Pat. No. 5,146,718 covers a hinged support assembly for a rain gutter. It rotates about an axis close to the gutter's front edge, i.e. remote from the fascia, therefore exposed to snow and ice sliding from the roof.

U.S. Pat. No. 5,184,435 describes a bracket, attached to the wall, which is equipped with a hinge screwed to the rain gutter. This installation is feasible only if the gutter has an essentially trapezoidal cross-section that provides a flat interface between the hinge and the gutter. Figures of the gutter assembly reveal the following limitations: the gutter requires to be drilled in order to interface with the hinge; attaching the hinge to a gutter with a half-round cross-section would be mechanically complex; the hinge axis is distant from the fascia so that when the gutter is in the downward position it is exposed to snow and ice sliding from the roof.

U.S. Pat. No. 5,274,965 describes a gutter bracket assembly that includes a gutter bracket which rotates with respect to a fascia bracket by means of pivots located along the front edge of the gutter, distant from the fascia. The gutter is maintained in the upward rain-gathering position by a snap-fit mechanism. In the downward position, the gutter is exposed to snow and ice sliding from the roof.

U.S. Pat. No. 5,752,347 discloses a flexible trough maintained in the upward rain-gathering position by a locking mechanism which engages the front edge of the trough, distant from the fascia. The hook which mechanically engages this edge is part of a cantilever that crosses the trough. After the trough has been folded against the fascia board, the cantilever remains in the path of snow and ice sliding from the roof.

U.S. Pat. No. 5,896,706 describes a rotating gutter reinforced with multiple stabilizing rings. It is mechanically complicated because it requires the gutter to have sufficient axial rigidity to ensure uniform rotation over a typical length of 30 ft. The gutter remains exposed to snow and ice sliding from the roof.

U.S. Pat. No. 6,233,876 discloses a gutter suspended from hinges equipped with bearings. All bearings are interconnected by a shaft fitted with a worm gear. The gutter is pivoted by rotating the shaft by means of a worm gear either manually of with an electric motor. The system is mechanically complicated and costly.

The first six of seven pivoting gutter systems described in the quoted patents are maintained in the upward rain-gathering position by interlocking mechanisms that rely on friction and spring forces. Their installation requires an accurate alignment between the interlocking elements on the fascia and on one of the gutter edges. In the last five of these six systems the gutter rotates downward about the front gutter edge, distant from the fascia. Consequently, the gutter remains exposed to the snow and ice sliding from the roof.

The last two of the quoted seven systems rely on supporting the gutter on bearings and rotating it as a mechanical assembly comparable to a long shaft. This type of configuration requires very accurate installation procedures and is costly. None of the seven pivoting gutter systems described in the quoted patents are currently in production.

SUMMARY OF THE INVENTION

The present invention relates to a pivoting gutter assembly mounted on supporting brackets, each bracket is attached to a magnetic latch. The magnetic latch comprises a magnet within a steel cup, mounted on the rear wing of a steel hinge attached vertically to the fascia. The magnet attracts with considerable force the downward pivotable front wing of the hinge fastened to the supporting bracket. The steel cup acts as a magnetic flux concentrator and increases the attraction force on the front wing. The gutter is in the upward rain-gathering position when the front wing of the steel hinge is in close contact with the magnet and the magnetic latch is closed. In order to move the gutter from the upward to the downward position, it suffices to exert a pull on the gutter's front edge, starting at one end and progressing to the other end, by means of a hook mounted on a pole that is manipulated from the ground. In late fall, the gutter is stored in the downward position under the eaves and remains protected from snow and ice sliding from the roof. If the gutter is left in the upward position in the winter, snow sliding from the roof will push it to the downward position without damaging it. In the downward position, the gutter can also be cleaned with a water jet from a garden hose or a brush mounted on a pole. In spring, the gutter will revert to its upward rain gathering position by pushing it up with a U-shaped fork on the previously mentioned pole, starting at one end and progressing toward the other end. When the hinge's front wing is approximately 0.8 in. from the magnet on the rear wing, the attraction force takes over and locks the gutter in the upward position.

Rainwater collected by the disclosed gutter assembly flows through a downspout that is connected to the gutter and pivots with it. The disclosed gutter assembly provides two embodiments for directing rain water from the pivoting downspout to a drain pipe.

In the first embodiment, water flows from the gutter through the pivoting downspout and from there into a fixed downspout connected to the drain pipe.

In the second embodiment, water flows from the gutter through the pivoting downspout into a connecting flexible hose that slides freely in the drain pipe.

DRAWINGS

Figures

The configuration and the functional characteristics of the invention are illustrated in the following figures.

Figure 6:
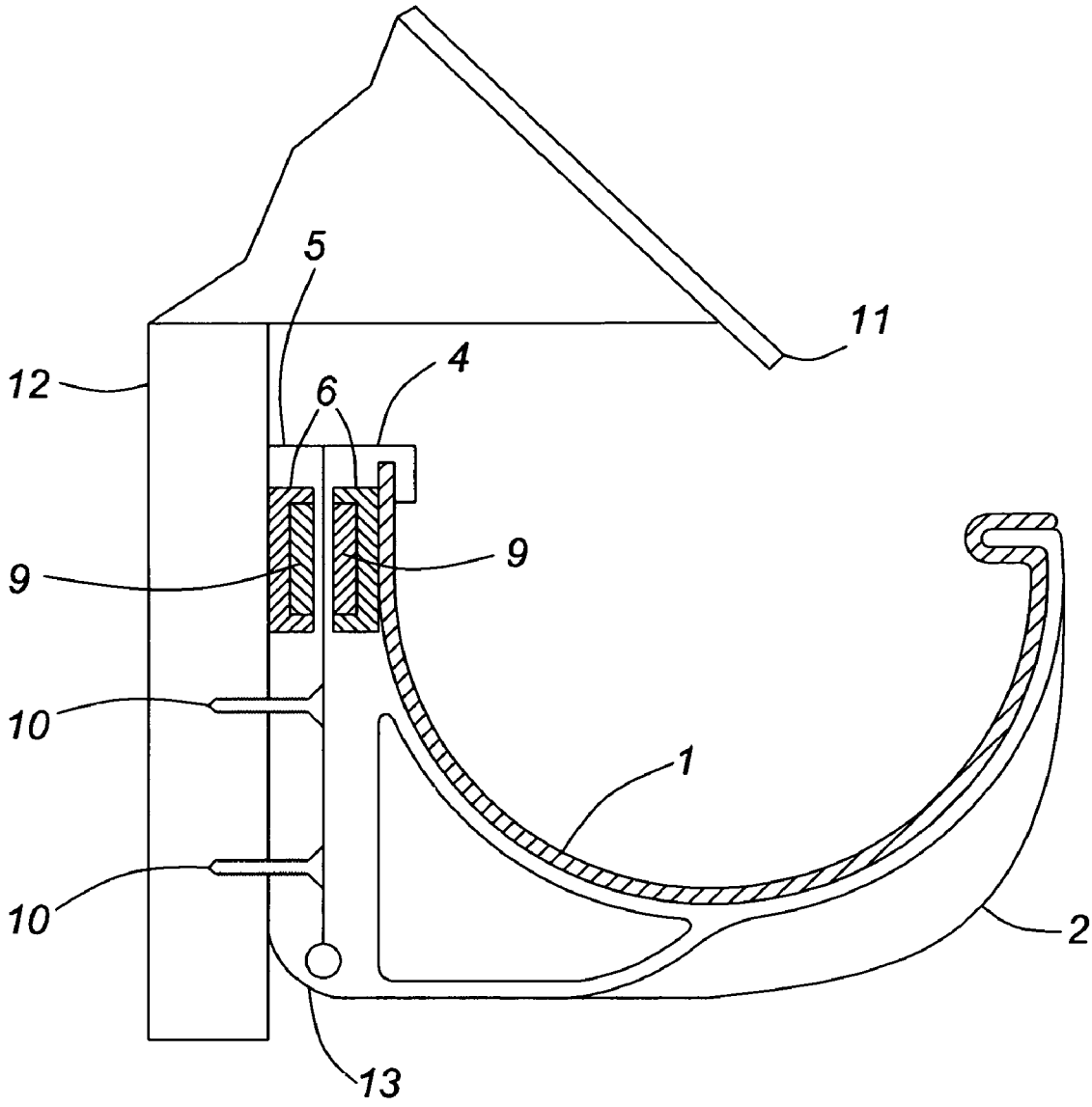
FIG. 6 shows the cross-section of the gutter and a plastic module that combines the function of the latch closed by two magnets of opposite polarity and that of a bracket supporting the lower part of the gutter.
Figure 6A:
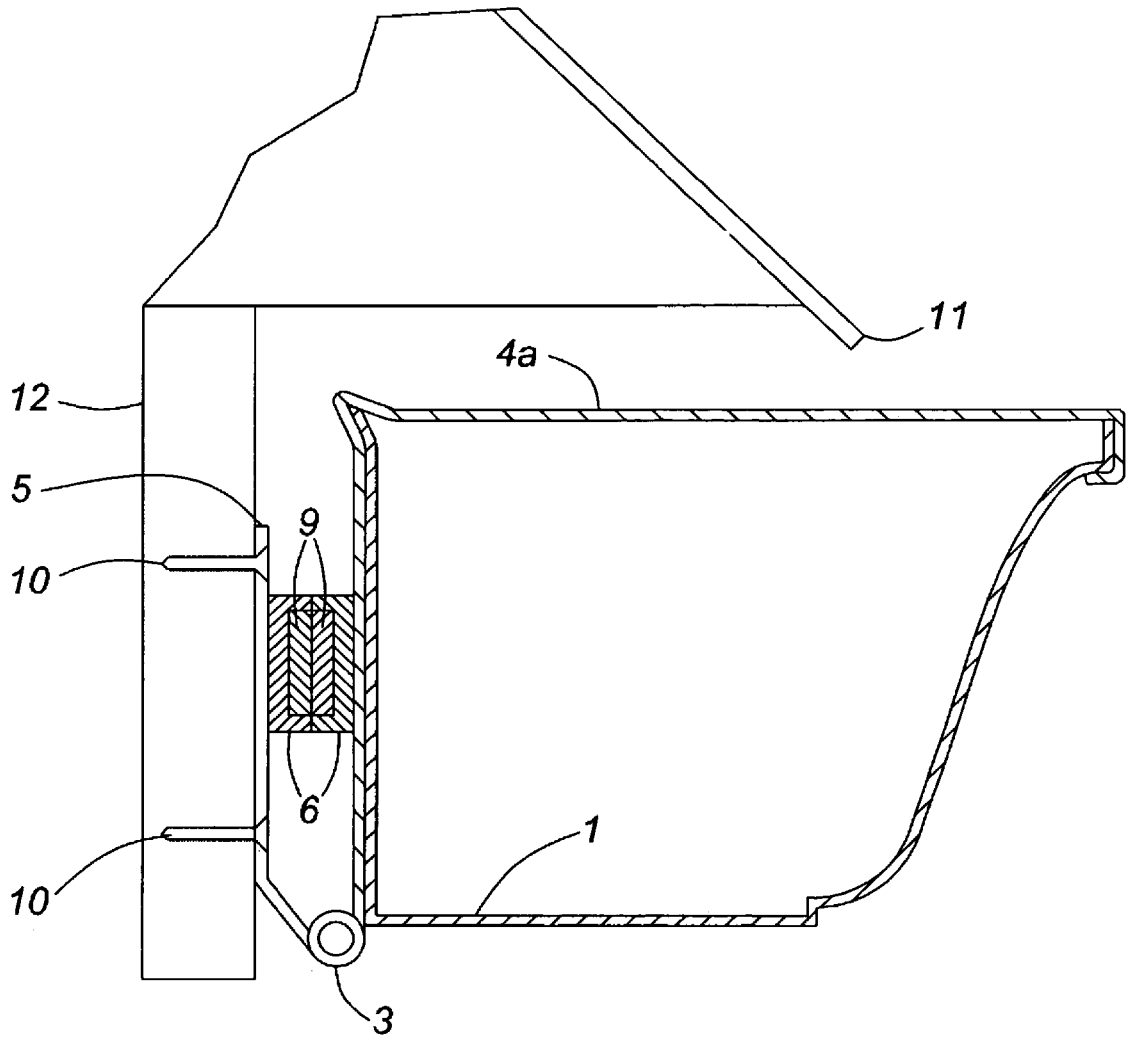

FIG. 6*a* shows the cross-section of the gutter and a metal module that combines the function of the latch closed by two magnets of opposite polarity and that of a hidden hanger supporting the upper part of a K-style gutter.

Figure 7:
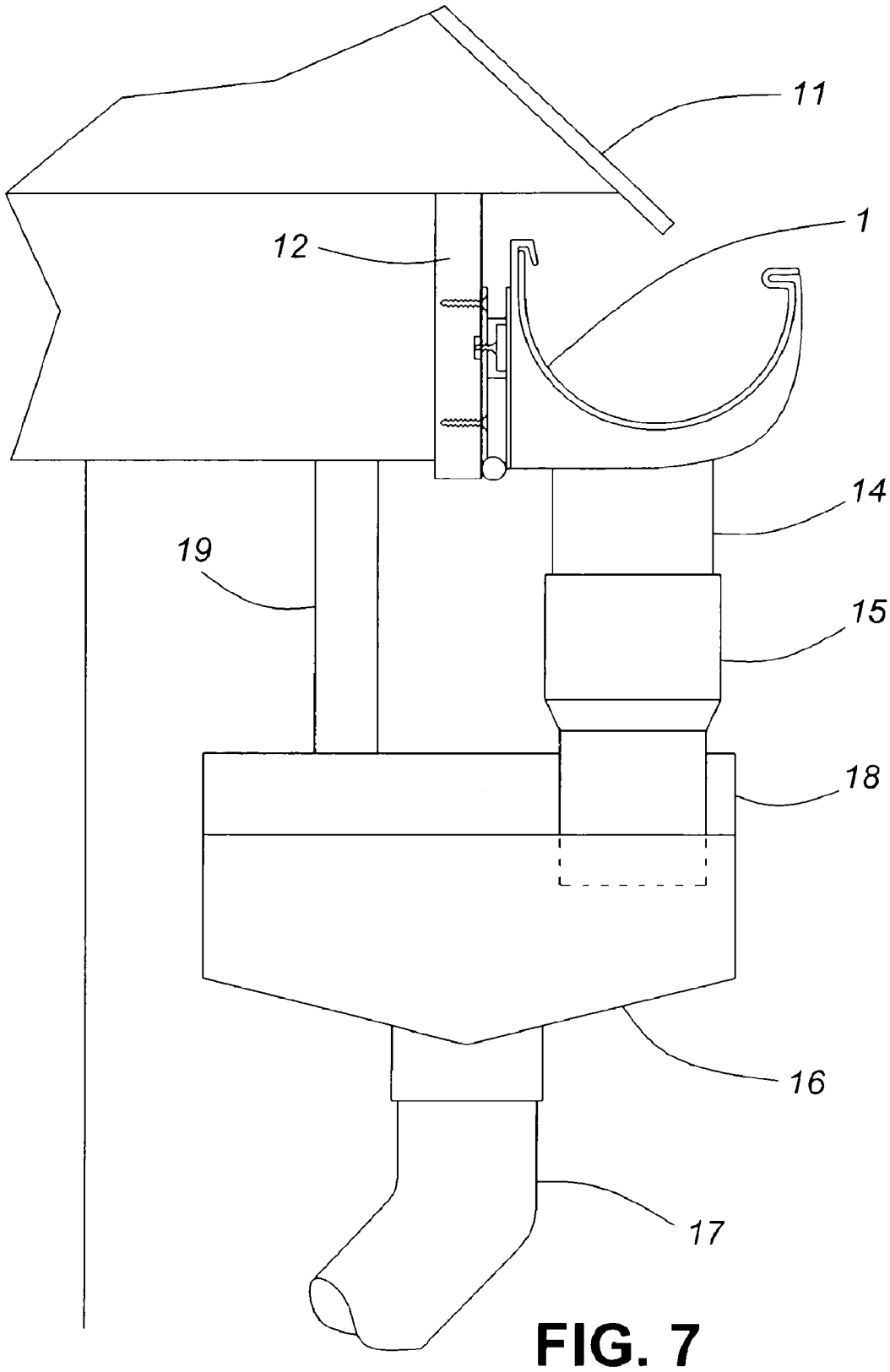

FIG. 7 is a side view the pivoting gutter in the upward position connected to a downspout. In this configuration, the pivoting downspout directs rain water into a fixed downspout and from there to a drain pipe. The end cap of the pivoting downspout is not shown.

Figure 8:
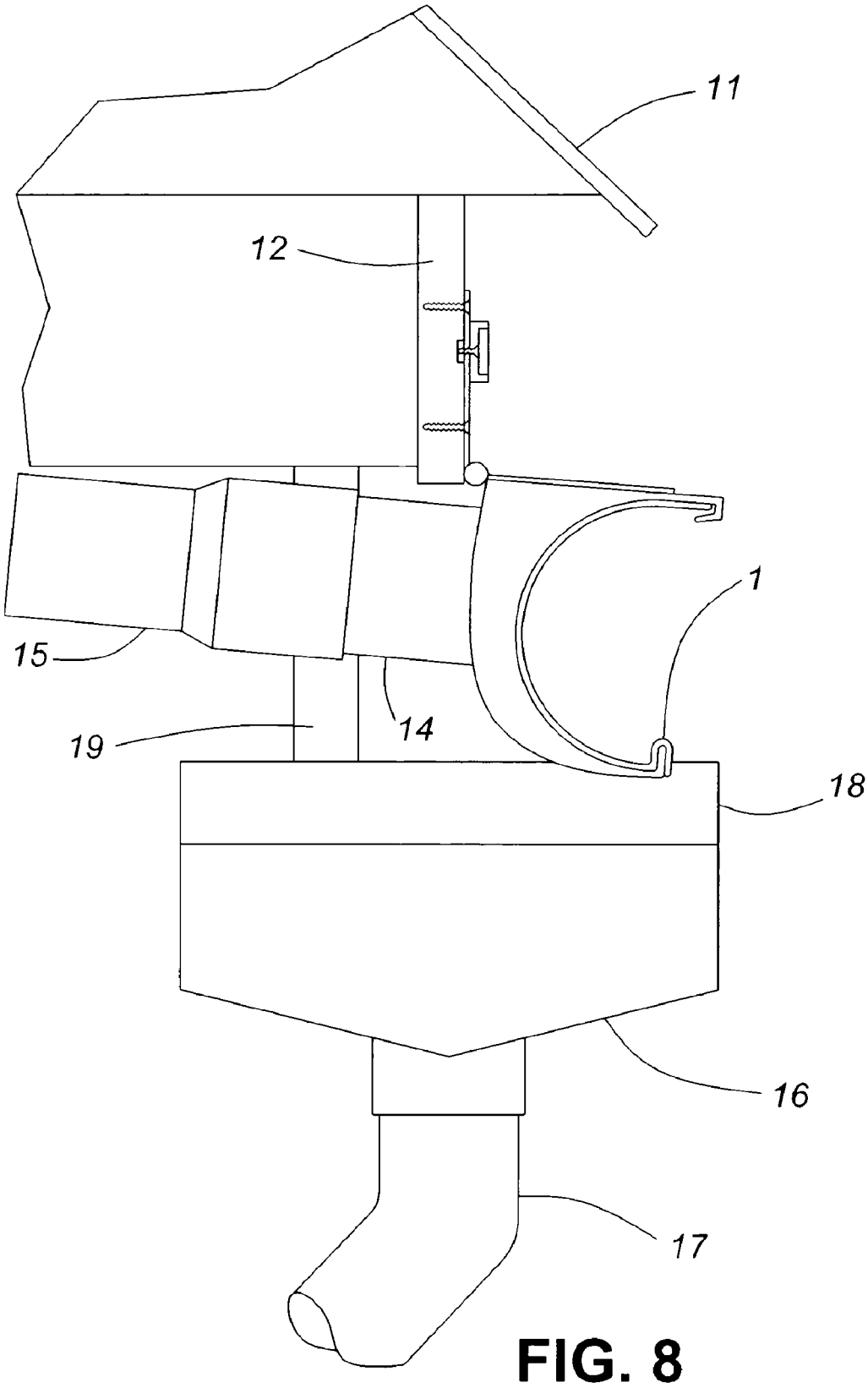

FIG. 8 is a side view of the pivoting gutter and the connected downspout in the downward position, ready to be cleaned with a water jet and protected under the eaves from snow and ice sliding from the roof. The end cap of the pivoting downspout is not shown.

Figure 9:
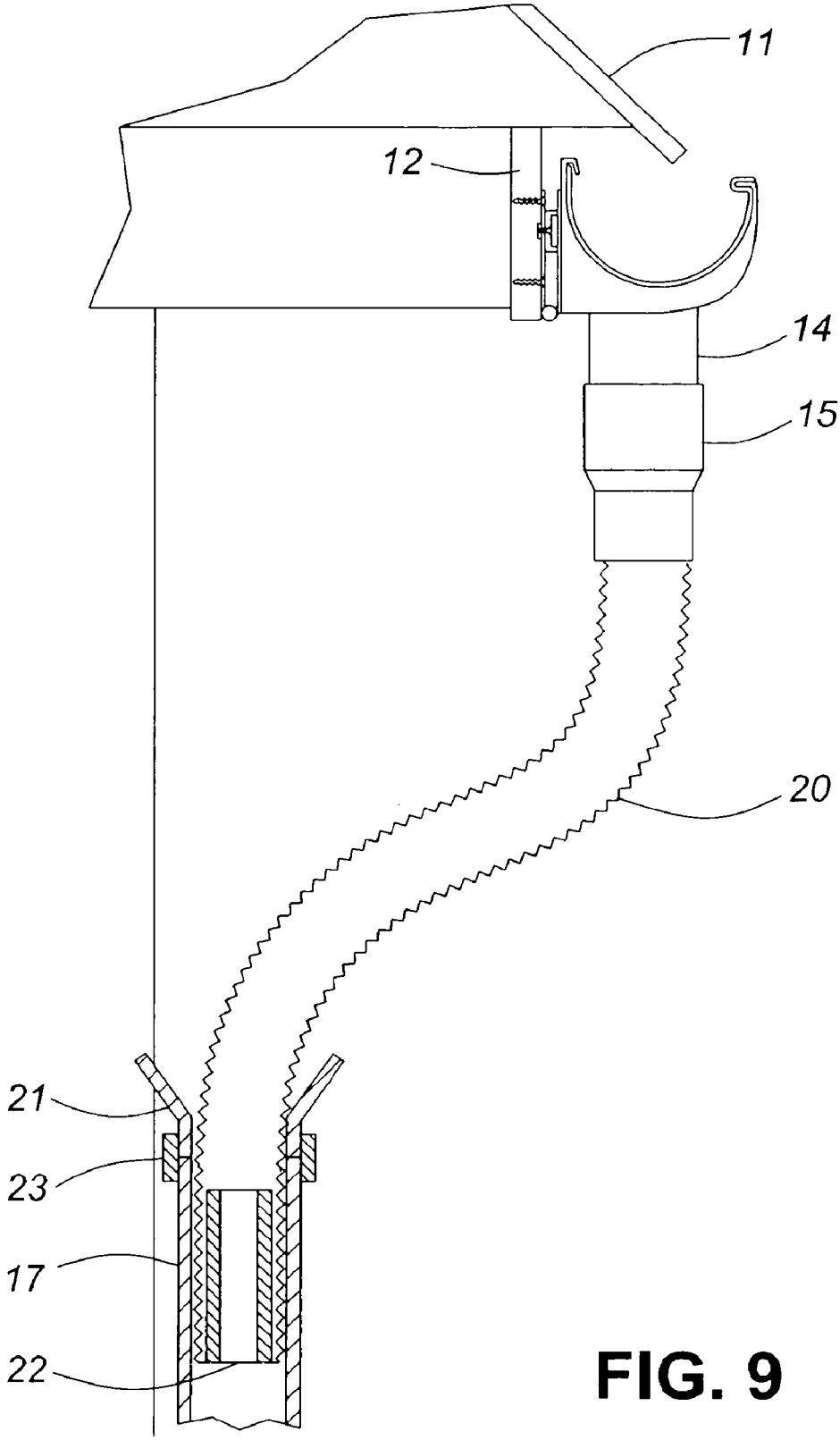

FIG. 9 illustrates the cross-section of a flexible hose connected to the pivoting downspout attached to the gutter in the upward position. Rain water flows from the pivoting gutter to the connected spout, through a flexible hose into the drain pipe. The end cap of the pivoting downspout is not shown.

Figure 10:
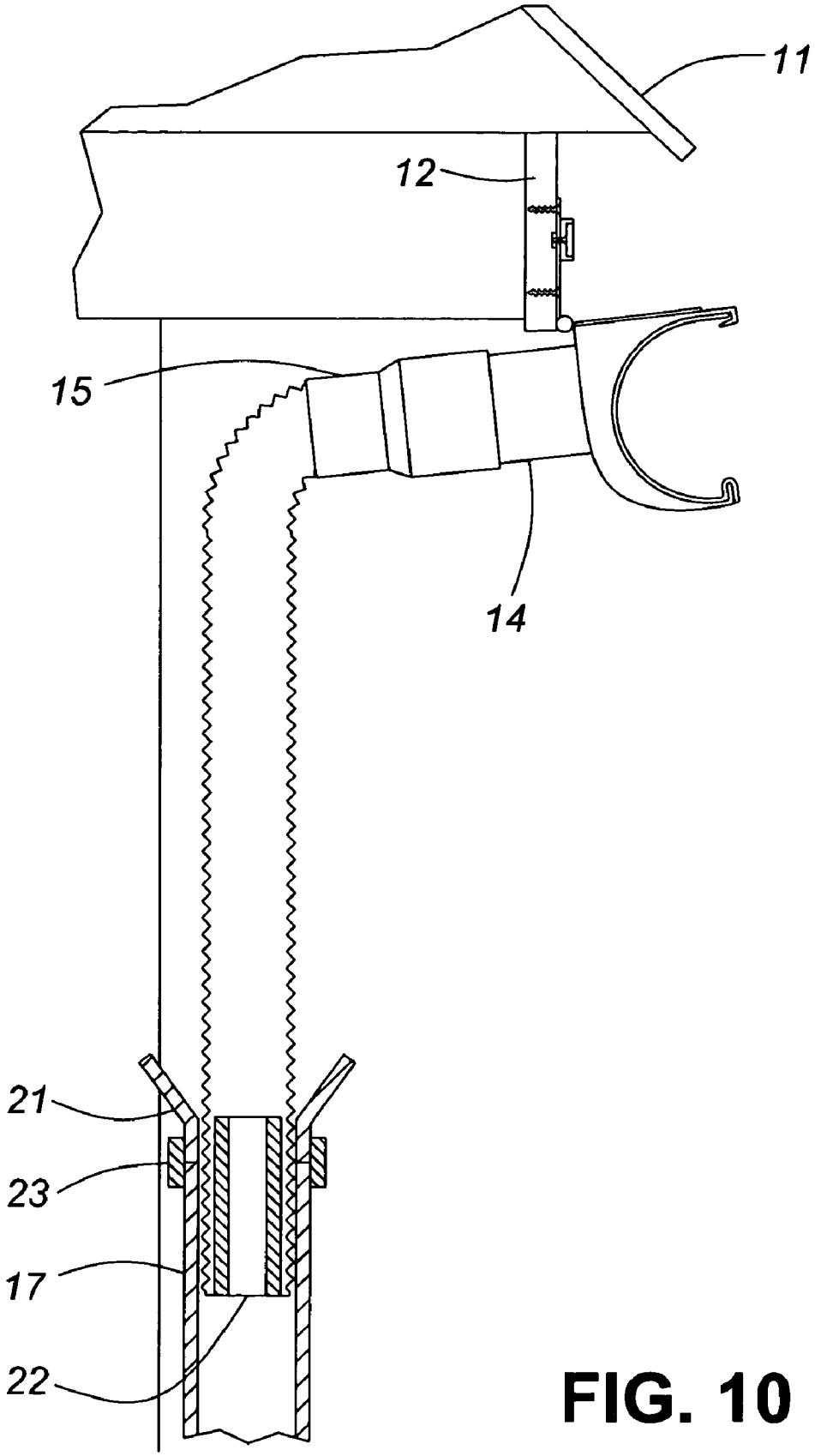

FIG. 10 illustrates the cross-section of the flexible hose connected to the pivoting downspout attached to the gutter in the downward position, ready to be cleaned with a water jet and protected under the eaves from snow and ice sliding from the roof. The end cap of the pivoting downspout is not shown.

DETAILED DESCRIPTION OF THE INVENTION

Figure 1:
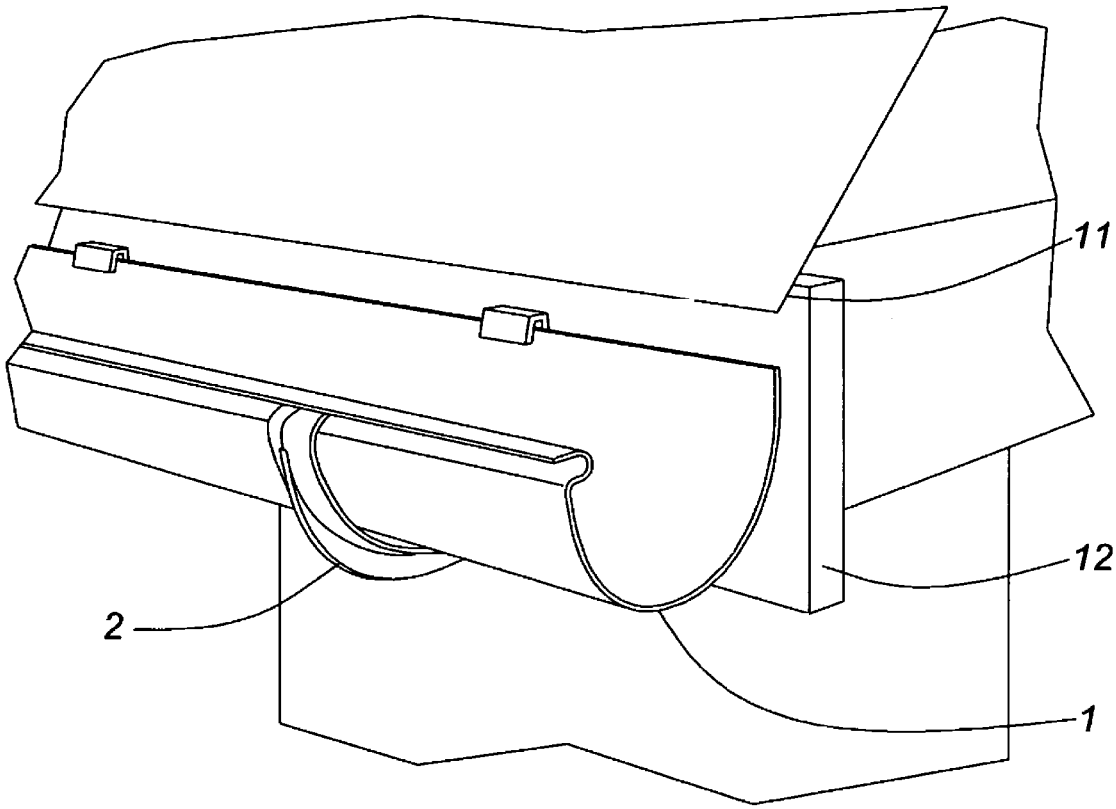
FIG. 1 is a perspective view of a half-round gutter in its upward rain-gathering position installed on a fascia.

The installation of a pivoting gutter assembly on the fascia is illustrated in FIG. 1. Gutter 1 supported by brackets 2 is installed on fascia 12 in the upward rain-gathering position under roof edge 11.

Figure 2:
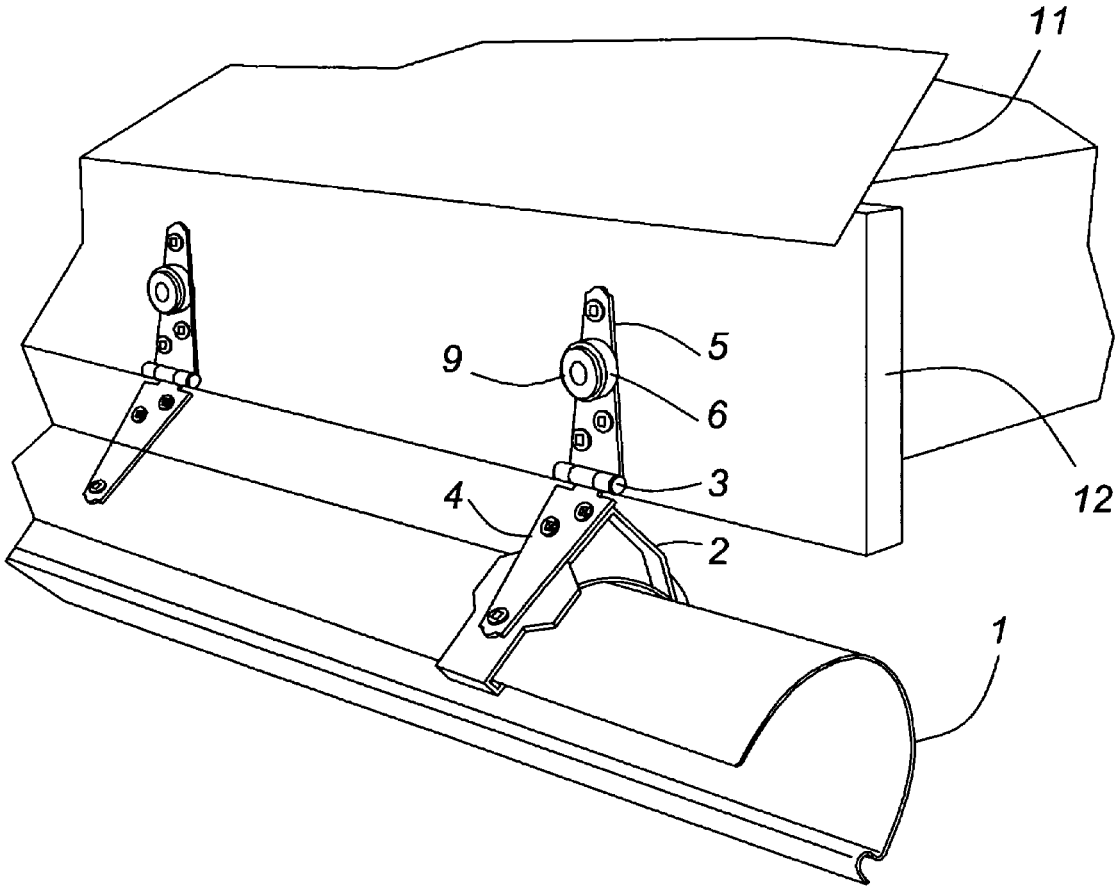
FIG. 2 is a perspective view of the half-round gutter in the downward position, ready to be cleaned with a water jet and protected under the eaves from snow and ice sliding from the roof.

Gutter 1 in the downward position stored under the eaves, is ready to be cleaned with a water jet and remains protected from sliding ice and snow, as shown in FIG. 2. Front wing 4 of steel hinge 3 is fastened to the rear of supporting bracket 2. Rear wing 5 of steel hinge 3 is attached with screws to fascia 12. Steel cup 6, containing magnet 9, is fastened to rear wing 5 of hinge 3. Steel cup 6 acts a magnetic flux concentrator and increases the attraction force of magnet 9 acting on front wing 4 of hinge 3. The device, comprising front wing 4 and steel cup 6 containing magnet 9 mounted on rear wing 5 of hinge 3, is a magnetic latch. Gutter 1 is brought up from the downward to the upward position from the ground, by applying an upward push to the gutter by means of a U-shaped fork mounted on a pole. This operation starts at one end of the gutter assembly and progresses to the other end. As front wing 4 approaches magnet 9, the attraction force ensures a strong lock between front wing 4 and magnet 9 in steel cup 6.

Figure 3:
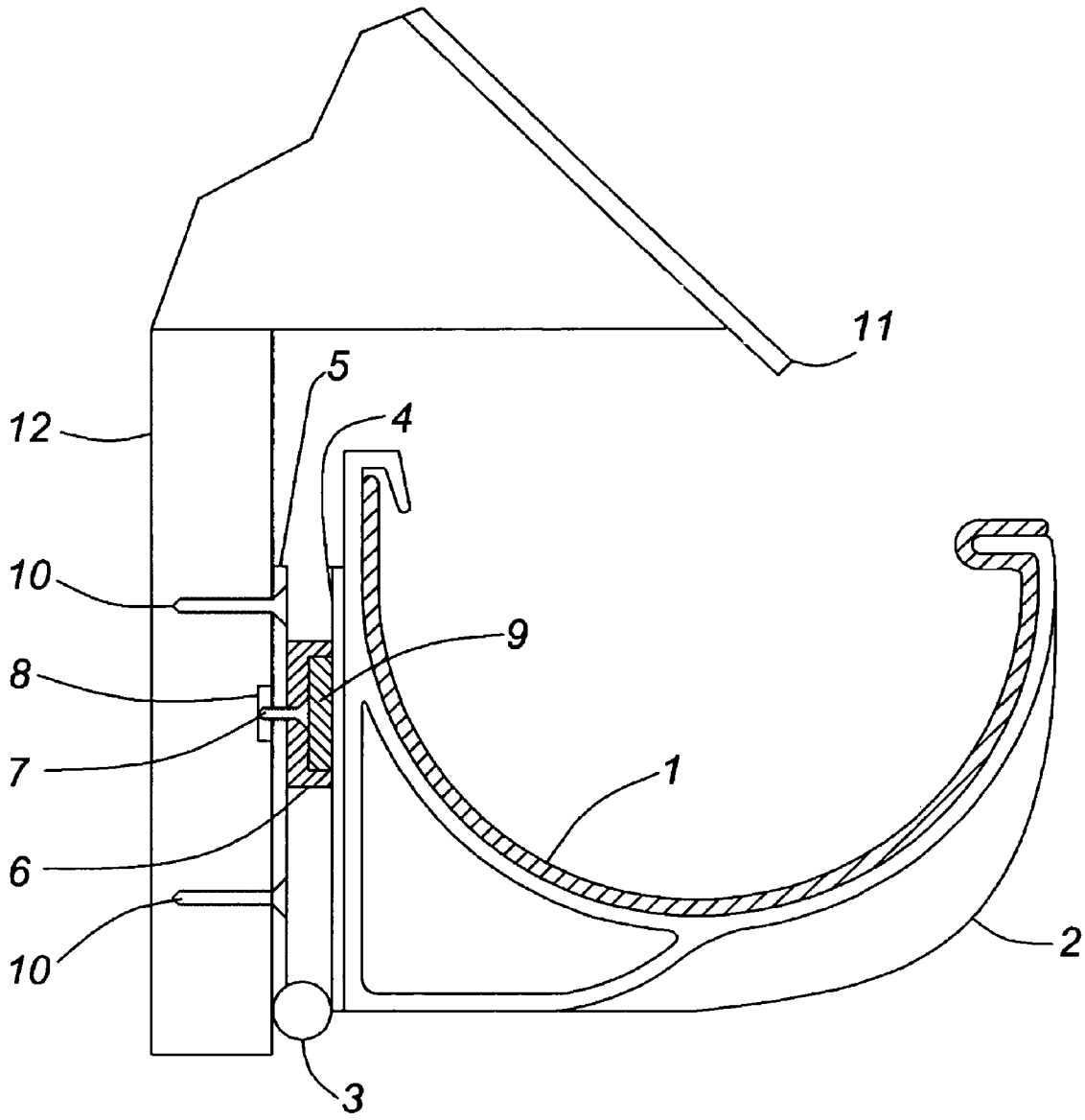
FIG. 3 illustrates the cross-section of the gutter and the magnetic latch, and the side view of the bracket supporting the lower part of the gutter. The closed magnetic latch holds the gutter in the upward position.

Additional details of the invention are shown in FIG. 3, which represents a cross-sectional view of the magnetic latch and half-round gutter 1 in the upward position, and the side view or bracket 2. Steel cup 6, containing magnet 9, is attached to rear wing 5 of hinge 3 by means of screw 7 and nut 8. Rear wing 5 of hinge 3 is fastened vertically to fascia 12 with wood screws 10.

Figure 4:
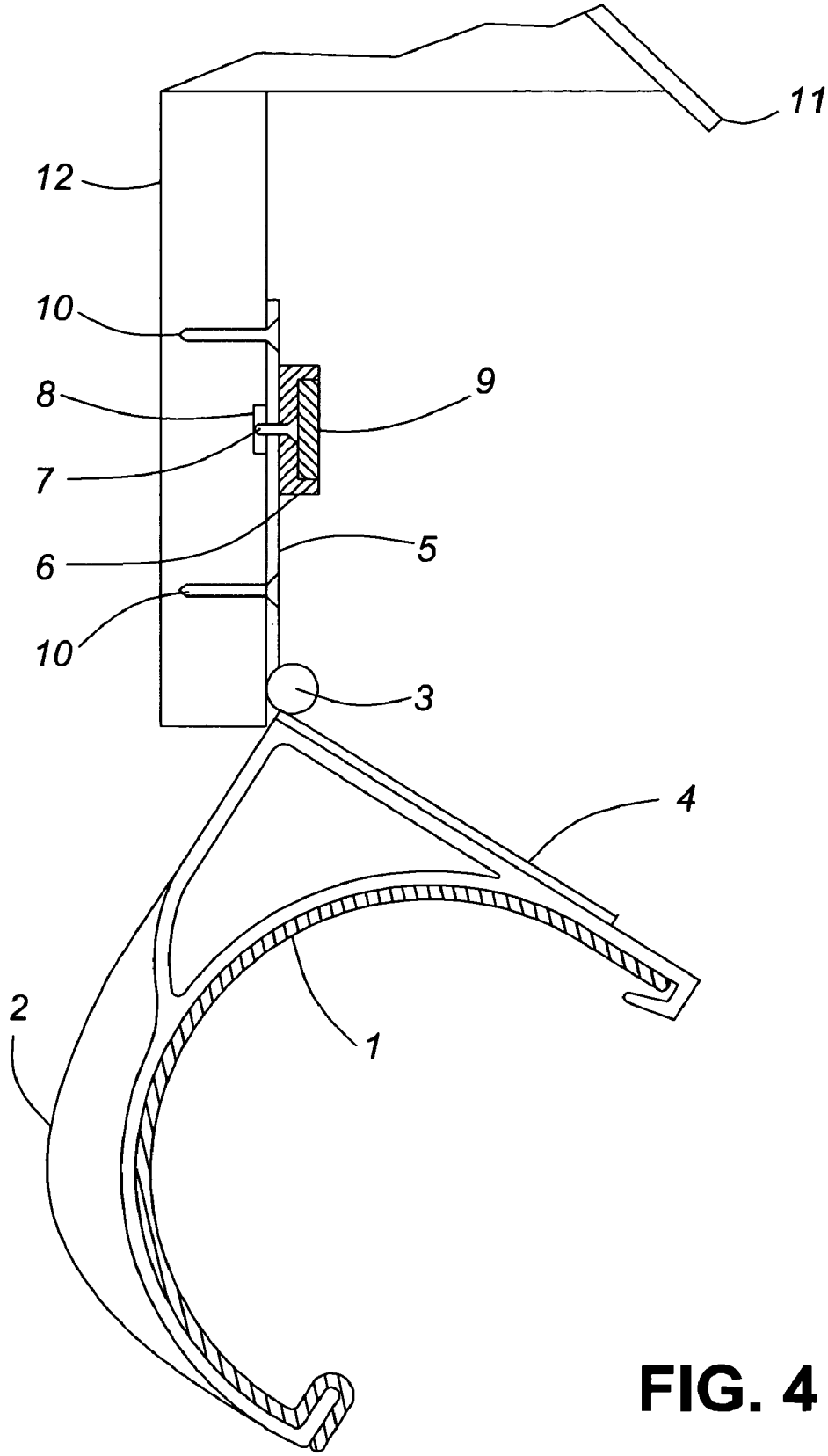
FIG. 4 illustrates the cross-section of the gutter and the magnetic latch in an open configuration and the gutter in the downward position.

Gutter 1 can be pulled down from the upward to the downward position shown in FIG. 4 from the ground, by means of a pole equipped with a hook. During this operation, a downward pull is applied to the front edge of the gutter, starting at one end and progressing toward the other end.

ADDITIONAL EMBODIMENTS

Figure 5:
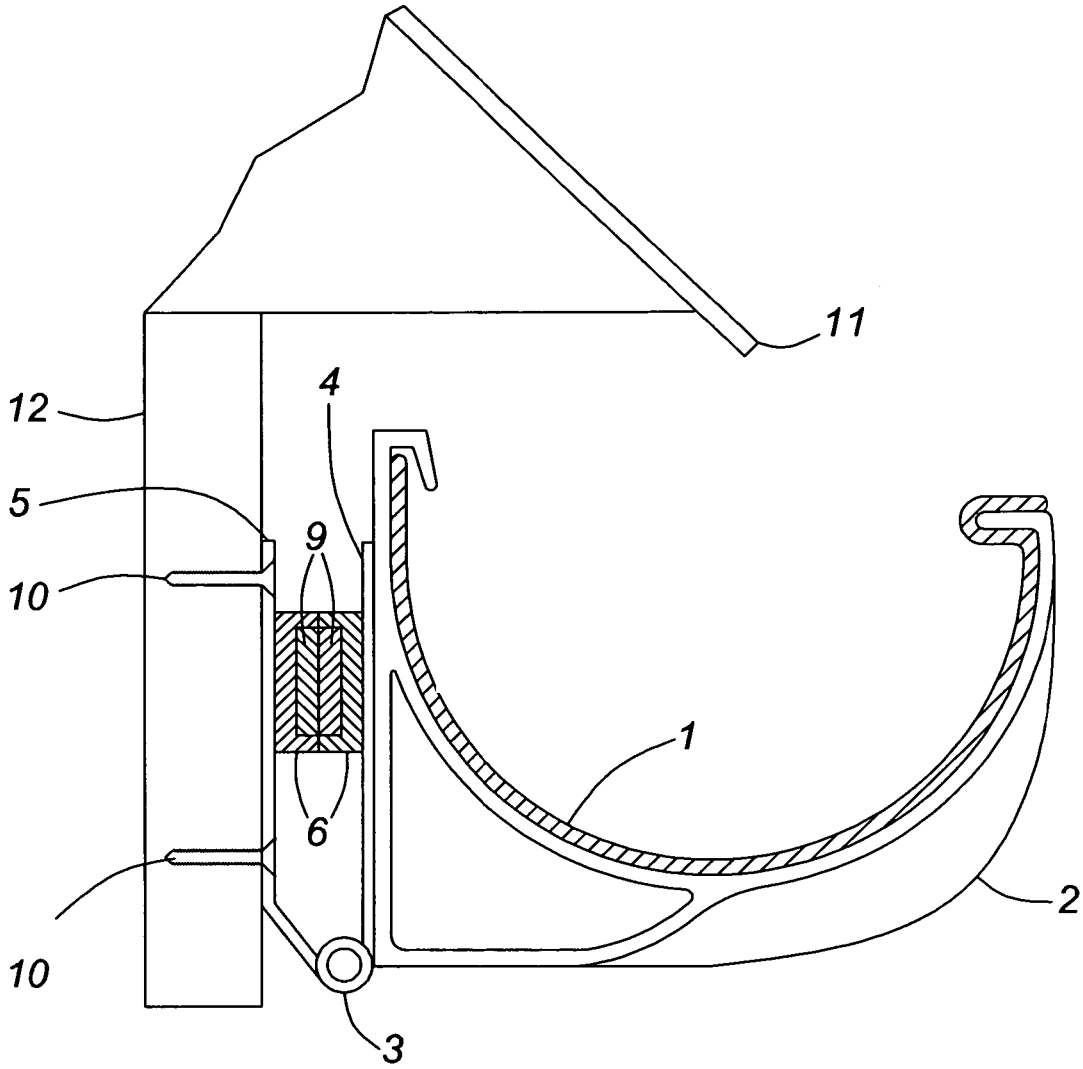
FIG. 5 shows the cross-section of the gutter and the latch closed by two magnets of opposite polarity, the gutter is in the upward position.

In an alternate embodiment of the invention shown in FIG. 5, another steel cup 6 containing magnet 9 of polarity opposite to the magnet on rear wing 5, is fastened to front wing 4 of hinge 3. This configuration results in a higher attraction force between the two magnets of the magnetic latch and therefore in a higher weight that can be supported by bracket 2 in the upward position.

The magnetic latch comprising steel hinge 3 with front wing 4 and rear wing 5, steel cup(s) 6 and magnet(s) 9 illustrated in FIGS. 3, 4 and 5 is an assembly of commercially available components. A production version of the magnetic latch is shown in FIG. 6. Bracket 2, wings 4 and 5 joined by living hinge 13 are manufactured by injection molding a plastic material. Steel cups 6 and magnets 9 of opposite polarity are included in the molding process. The result of this process is a magnetic latch and bracket assembly supporting the lower part of the gutter.

An alternate embodiment of the invention that supports the upper part of a K-style metal or plastic gutter is shown in FIG. 6*a*. The configuration of metal front wing 4 can be modified to include hidden hanger 4*a* that supports the upper part of the gutter. The resulting pivoting gutter assembly will perform in the same manner as the previously described half-round gutter assembly.

Water Drainage

A downspout that directs the flow of rain water to a drain pipe is located either at the lower end of the sloping gutter or at approximately its midpoint. It therefore pivots with the gutter. The invention includes two embodiments for ensuring that the pivoting downspout empties into the drain pipe when gutter 1 is in the upward rain-gathering position.

In the first embodiment illustrated in FIG. 7, rain water collected by gutter 1 in the upward position flows into pivoting downspout 14 through extender tube 15, into fixed downspout 16 and drain pipe 17. Fixed spout 16 is fastened to mounting board 18 which is attached to fascia 12 by support 19. When gutter 1 is in the downward position shown in FIG. 8, pivoting downspout 14 and extender tube 15 are approximately horizontal, stored under the eaves and protected from snow and ice sliding from the roof. Pivoting downspout 14 and fixed downspout 16 may have the same configuration. FIGS. 7 and 8 show the side view of pivoting downspout 14 without an end cap.

In the second embodiment shown in FIG. 9, rain water collected by gutter 1 in the upward position flows into pivoting downspout 14, through extender tube 15 and then through flexible hose 20 into drain pipe 17. The upper end of hose 20 is attached to the inner wall of extender tube 15, while the lower end slides freely in funnel 21 and drain pipe 17. This sliding motion during the transition of pivoting downspout 14 from the upward to the downward position is facilitated by the downward pull of weight 22, attached to the inner wall of flexible hose 20. A typical embodiment of weight 22 is a section of metal pipe. Drain pipe 17 and funnel 21 are made of metal or plastic material and they are interconnected by means of a snug-fit metal or plastic ring 23. When gutter 1 and pivoting downspout 14 are in the downward position, flexible hose 20 adapts to this configuration illustrated in FIG. 10, as its weighted lower end slides freely in funnel 21 and drain pipe 17. FIGS. 9 and 10 show the side view of pivoting downspout 14 without the end cap.

Additional Feature of the Pivoting Gutter

It is emphasized that even if the gutter assembly is left in the upward position during winter, it remains protected against sliding snow and ice. The magnetic latches act as mechanical safety switches. They open if the gutter assembly is struck by snow and ice sliding from the roof, and gutter 1 as well as pivoting downspout 14, are pushed to the downward position without being damaged.

CONCLUSION

The detailed description of the pivoting gutter assembly supported by magnetic latches highlights its following advantages:

a. The magnetic latch is devoid of stiction and friction. It therefore opens and closes more easily than interlocking mechanisms in prior art.

b. The installation of the plurality of magnetic latches on the fascia is simpler and requires less accuracy than the installation of interlocking mechanisms in prior art.

c. The plurality of magnetic latches can support a weight approximately four times higher than the weight of the gutter fully filled with water. This capability has been verified experimentally on a prototype installation.

d. If the gutter is left in the upward position in winter, the magnetic latches act as mechanical safety switches. The impact on the gutter of snow and ice sliding from the roof opens the magnetic latches and pivots the gutter under the eaves. This functional feature has been verified on a prototype installation.

e. Magnetic latches can be easily included in the process presently used to manufacture fixed supporting brackets for gutters.

The foregoing has constituted a description of specific embodiments showing how the invention may be applied and put into use. These embodiments are only exemplary. The invention in its broadest and more specific aspects is further described and defined in claims that follow the concluding statements.

These claims, and the language used therein, are to be understood in terms of the variants of the invention which have been described. They are not to be restricted to such variants, but are to be read as covering the full scope of the invention as is implicit within the invention and the disclosure that has been provided herein.

I claim:

1. A pivoting gutter assembly for attachment to a fascia surface on a building comprising:

a. a fascia including an elongated rectangular section of appropriate building material installed under the eaves of a building, b. a metal or plastic rain gutter of appropriate cross-section, c. a plurality of magnetic latches mounted at predetermined distances from one another along the full length of the fascia, d. a metal or plastic bracket fixated to each magnetic latch, the plurality of the brackets providing the means for supporting the lower part or the upper part of said gutter, e. said plurality of magnetic latches providing the means for maintaining the gutter in the upward rain-gathering position and the means for pivoting said gutter to the downward position under the eaves, where said gutter is accessible for cleaning and protected from sliding snow and ice, wherein each magnetic latch comprises:

a hinge comprising a rear wing including an elongated steel plate shorter than the fascia's height, said rear wing having a plurality of holes for fixating said rear wing to the fascia close to perpendicularly with respect to the fascia's longitudinal dimension, a front wing including an elongated steel plate having a plurality of mounting holes, a metal in providing the means for rotating the front wing with respect to the rear wing, a cup comprising a flat-faced, pill-shaped steel block of symmetrical cross-section having a coaxial cavity, said cup being fixated to the rear wing of said hinge, a magnet of appropriate dimensions closely fitting into said cavity, a metal or plastic bracket fixated to the front wing, said plurality of brackets providing the means for supporting the gutter, wherein said magnet providing the means for closing said magnetic latch by attracting the front wing of said hinge when placed in the vicinity of said magnet, and f. a downspout attached either to the lower end of said gutter or approximately at midpoint of said gutter, said downspout pivots with the gutter, said pivoting gutter assembly having the capability of remaining in the upward rain-gathering position when subjected to downward forces equal to at least three times the weight of water in a full gutter.

2. The pivoting gutter assembly of claim 1, wherein the steel cups containing the magnets are attached to the front wings of hinges providing the means of attraction to the rear wings, thereby closing the plurality of magnetic latches.

3. The pivoting gutter assembly of claim 1, wherein the steel cup attached to each rear wing of each hinge contains the magnet of the same polarity facing outward and the steel cup attached to each front wing contains the magnet of opposite polarity facing outward, whereby mutual attraction created between respective magnets of opposite polarity provides the means for closing the plurality of magnetic latches.

4. The pivoting gutter assembly of claim 1, wherein the hinges and the cups containing the magnets are made on a material having a high magnetic permeability.

5. The pivoting gutter assembly of claim 3, wherein each magnetic latch comprises:

a. a hinge molded as a single module of a plastic material, wherein the rear wing and the front wing are linked by a thin, flexible living hinge, said rear wing and said front wing each having a cavity for embedding the steel cup containing the magnet, b. the magnets in the rear wing and the front wing being of opposite polarity.

6. The pivoting gutter assembly of claim 1 wherein the means for directing water flowing from the roof comprise:

a. a funnel-shaped downspout fixated to the gutter's lower end and pivoting with the gutter, b. an appropriately supported drain pipe located underneath said downspout, c. a metal or plastic funnel attached to the upper end of said drain pipe, d. a flexible hose, attached to the rotatable downspout, inserted into a metal or plastic funnel mounted atop the upper end of said drain pipe, said hose sliding freely in said drain pipe as the gutter pivots, e. a section of pipe of predetermined weight inserted in the lower end of said hose providing the means for applying tension to the hose as the gutter rotates, thereby preventing the hose from bulging when the gutter is in the downward position.

7. The pivoting gutter assembly of claim 1 wherein the plurality of magnetic latches provide the means for protecting the gutter against the impact of snow and ice sliding from the roof, by opening on impact and pivoting said gutter under the eaves.

8. The pivoting gutter assembly of claim 5, wherein each magnetic latch comprises:

a. the rear wing having the cavity for embedding the steel cup containing the magnet, b. the front wing containing the cavity for embedding an appropriate element of ferromagnetic material for attraction to said magnet.

9. The pivoting gutter assembly of claim 5, wherein each magnetic latch comprises:

c. the front wing having the cavity for embedding the steel cup containing the magnet, d. the rear wing containing the cavity for embedding the appropriate element of ferromagnetic material for attraction to said magnet.

* * * * *